US005427903A

United States Patent [19]

Suzuki et al.

[11] Patent Number: 5,427,903

[45] Date of Patent: * Jun. 27, 1995

[54] SILVER HALIDE PHOTOGRAPHIC LIGHT-SENSITIVE MATERIAL

[75] Inventors: Katsuhiko Suzuki; Satomi Kawabe; Tomoyuki Nakayama; Hiroyuki Hoshino, all of Hino, Japan

[73] Assignee: Konica Corporation, Japan

[ * ] Notice: The portion of the term of this patent subsequent to May 2, 2012 has been disclaimed.

[21] Appl. No.: 282,161

[22] Filed: Jul. 28, 1994

Related U.S. Application Data

[63] Continuation of Ser. No. 930,309, Aug. 13, 1992, abandoned.

[30] Foreign Application Priority Data

Aug. 20, 1991 [JP] Japan ..... 3-208211

[51] Int. Cl.[6] ..... G03C 1/005

[52] U.S. Cl. ..... 430/567; 430/569

[58] Field of Search ..... 430/567, 569

[56] References Cited

U.S. PATENT DOCUMENTS 5,061,615 10/1991 Kase et al. ..... 430/569
5,124,244 6/1992 Waki et al. ..... 430/569
5,171,659 12/1992 Tsaur et al. ..... 430/569

FOREIGN PATENT DOCUMENTS 57-92523 6/1982 Japan ..... C01G 5/02
57-92524 6/1982 Japan .
59-52238 3/1984 Japan ..... G03C 1/02
59-177535 10/1984 Japan ..... G03C 1/02
60-35726 2/1985 Japan ..... G03C 1/02
60-138538 7/1985 Japan ..... G03C 1/02
60-143331 7/1985 Japan ..... G03C 1/02
60-258536 12/1985 Japan ..... G03C 1/02
61-14636 1/1986 Japan ..... G03C 7/20
61-14844 1/1986 Japan ..... B23O 41/02
61-245151 10/1986 Japan ..... G03C 1/02
62-160128 7/1987 Japan ..... B01J 4/00

*Primary Examiner*—Janet C. Baxter
*Attorney, Agent, or Firm*—Jordan B. Bierman; Bierman and Muserlian

[57] ABSTRACT

Disclosed is a silver halide photographic light-sensitive material comprising an induced absorption peak intensity not less than 3.5 units and a long-lived light component intensity not less than 0.50 unit in the microwave photo conductivity measurement.

A silver halide color photographic light-sensitive material is improved in a sensitivity and excellent in high intensity reciprocity law failure.

10 Claims, No Drawings

SILVER HALIDE PHOTOGRAPHIC LIGHT-SENSITIVE MATERIAL

This application is a continuation of application Ser. No. 07/930,309, filed Aug. 13, 1992, now abandoned.

FIELD OF THE INVENTION

The present invention relates to a high-sensitivity silver halide photographic light-sensitive material, particularly to a silver halide photographic light-sensitive material high in sensitivity, excellent in high illuminance reciprocity law failure property, and less in fog due to aging after manufacture.

BACKGROUND OF THE INVENTION

In the area of the silver halide photographic light-sensitive material, high-sensitivity color light-sensitive materials have been developed with the advance of related techniques.

However, a light-sensitive material having a much higher sensitivity is demanded in specific uses such as indoor photography, astronomical photography and sports photography. Particularly in recent years, with the appearance of a camera having a much higher shutter speed, there has been increasing the demand for a light-sensitive material having a much higher sensitivity and a much better reciprocity law failure property in a short-time exposure under a high illuminance.

To satisfy this requirement, there have been conducted various studies to develop a light-sensitive material having a much higher sensitivity and a much better reciprocity law failure property in a short-time exposure under a high illuminance (hereinafter referred to as a high illuminance reciprocity law failure property).

In order to improve the high illuminance reciprocity law failure property, the present inventors have made a study on various phases of the problem including silver halide compositions and methods for manufacturing light-sensitive materials.

In the course of the study, close examinations were made to open a way for the technical improvement. And in microwave photoconductivity measurements of silver halide photographic light-sensitive materials which were made as an approach from the physical aspect, the present inventors found that there is a strong correlation between the intensity of a long-lived component in the microwave photoconductivity measurement and the high illuminance reciprocity law failure property.

This correlation is not yet theoretically interpreted, and its theoretical elucidation remains as a problem to be solved later.

But, the present inventors made a further study based on the above finding and, through the utilization of such a correlation, succeeded in making a silver halide emulsion excellent in high illuminance reciprocity law failure property by lengthening the life of photoconductivity.

It was also found in such a study that an emulsion comprised of core/shell crystal grains having a higher silver iodide content in the core portion than in the shell portion is one preferable example of emulsions for making a silver halide light-sensitive material having a high sensitivity and containing such a long-lived light component in the microwave photoconductivity measurement.

When a photographic light-sensitive material was prepared by use of such an emulsion, the high illuminance reciprocity law failure property was improved; but, as another problem, deterioration in photographic properties is caused by increase in fog due to aging in the interval between manufacture and use.

SUMMARY OF THE INVENTION

Accordingly, the object of the invention is to provide a silver halide light-sensitive material high in sensitivity, excellent in high intersity reciprocity law failure property, and less in increase of fog attributable to aging between manufacture and use.

DETAILED DESCRIPTION OF THE PREFERRED EMBODIMENT

The object of the invention is achieved by a silver halide photographic light-sensitive material having an induced absorption peak intensity not less than 3.5 units and a long-lived light component intensity not less than 0.50 unit in the microwave photoconductivity measurement.

The present invention is hereunder described in detail.

This invention is defined by characteristics of a silver halide photographic light-sensitive material in the microwave photoconductivity measurement.

The microwave photoconductivity measurement is well known in the art as a means to evaluate physical properties of a silver halide photographic emulsion, and can be carried out according to the method described, for example, by L. M. Kellog in "Photographic Science and Engineering", Vol. 18, p. 378 (1974).

The conditions used in the microwave photoconductivity measurement of the invention are hereunder described in detail.

As a microwave generator, a Gunn Diode Oscillator Model EMG-10BD made by Echo Densi Co. (frequency range: 8.5–9.5 GHz, output: about 100 mw) is used. The sample cavity resonator used is a rectangular type of $TE_{108}$ mode (Model ESC/10TS made by Echo Densi Co., resonance frequency: 9352 Hz, degree of coupling: 40–100% variable, load: $Q>3000$ (without insertion of a sample), which forms a wave bridge by means of a magic tee. On both sides of the sample cavity resonator, 5-mm wide and 20-mm high windows are provided for light irradiation. In the measurement of a photographic light-sensitive material's conductivity change caused by exposing, the balance of the bridge is destroyed by changing Q of the resonator, so that an unbalanced portion of the microwave output corresponding to the change in sample's conductivity appears at the output-terminal of the microwave bridge. This output is detected by homodyne reception with a crystal diode (Crystal Mount ECM-10B made by Echo Densi Co.). Then, it is amplified (60 dB amplification, frequency range of the amplifier: DC-60 MHz) and recorded on a waveform recorder for data processing.

A photographic light-sensitive material to be inserted into the sample resonator is a strip film having a size of 5 mm×20 mm and is placed at the center of the resonator with its faces confronting the windows so as to be in parallel with the propagating direction of microwaves.

As a light source to expose the sample, a xenon flash lamp (Stroboscope Type MS-230 made by Sugahara Laboratory) was used. The interval between the protective glass of the lamp and the window of the resonator was 18 cm, and the sample was irradiated with the light condensed by a lens having an aperture of 50 mm and a focal length of 100 mm (made by Quartz Glass) placed at a distance of 8 cm from the window.

In the invention, the induced absorption peak intensity in the microwave photoconductivity measurement and the long-lived light component intensity are defined as follows:

The microwave photoconductivity of a silver halide light-sensitive material is measured by the above method, and a maximum signal and a signal at 8 μsec later the irradiation of excited light in a microwave induced absorption curve are converted into values per coated silver amount of 1 mg/100 $m^2$, respectively The converted values are independently calibrated with a standard sample and taken as a peak intensity and a long-lived component intensity, respectively. Subsequently, measurement is made under the same conditions as with the above coated paint, using Super HG400 (production No. 323579) made by Fuji Photo Film Co. and Kodak Gold 400 (emulsion No. 608 C21A) made by Eastman Kodak Co. as standard samples. The measured values are converted into values per coated silver amount of 1 mg/100 $m^2$, then calibration is carried out by setting the peak signal values of the respective standard samples at 3.1 units and 5.3 units, and the signal values of those 8 μsec after light irradiation at 1.03 units and 0.45 unit.

For a silver halide photographic light-sensitive material having a high sensitivity and an improved high illuminance reciprocity law failure property, deterioration due to aging fog can be prevented as follows. In one method, a proper means is taken to minimize silver nuclei present in silver halide grains, so that the peak intensity in the photoconductivity measurement is increased with the long-lived component intensity kept high.

In view of the object of the invention, it is advantageous to use a silver halide emulsion prepared under conditions where silver nuclei are not produced in quantity.

In silver halide grains containing less silver nuclei internally, electrons are trapped inside of grains and prevented from being deactivated; therefore, the object of the invention can be effectively achieved by use of such grains.

Silver nuclei present in silver halide grains can be reduced by various methods, in which processes from silver halide nucleus formation to completion of grain growth are carried out in an oxidizing environment, or in the presence of an inhibitor, or by use of the acid method. Of these methods, the method of carrying out the processes from nucleus formation to completion of grain growth in an oxidizing environment is preferred; as means to conduct the method, there can be used addition of an oxidizing agent or removal of reducing substance. oxidizing agents used include conventional ones such as hydrogen peroxide, nitric acid, nitrous acid, bromine and iodine.

Preferred ones are hydrogen oxide and iodine.

Iodine is particularly preferred since it does not affect photographic properties. The addition amount of iodine is preferably 2 to 200 mg/mol AgX, especially 5 to 100 mg/mol AgX.

Iodine can be added in the form of a solution in water, methanol or mixture of these, or may be added as it is.

The oxidizing agent is added during the period between nucleus formation and completion of grain growth; preferably, it is added by the initial stage of grain growth; particularly preferably, it is added by the start of grain growth.

Reducing substances can be removed by use of a dispersion medium containing less reducing substances in the preparation of silver halide grains.

The content of reducing substances in a dispersion medium can be cut down by a generally known method such as treatment with hydrogen peroxide.

In the invention, determination of reducing substances was made in the following procedure:

(1) In a 250-ml conical flask were added 10 g of gelatin, 140 ml of water and 4 ml of 1N aqueous solution of sodium hydroxide.

(2) The gelatin was allowed to swell for 2 hours at 10° C.

(3) The gelatin was dissolved at 50° C. as rapidly as possible with a careful stirring not to form air bubbles.

(4) The solution was cooled to 30° C., then reagents were added in the following manner:

(a) adding 8 ml of a sulfonic acid solution, followed by stirring (b) adding 6 ml of sulfuric acid solution, followed by stirring (c) adding 10 ml of a potassium iodide solution (e) stirring the solution adequately (f) titrating the solution with 0.01N iodine solution The reagents used in the steps (a) to (f) were as follows:

| | |
|---|---|
| Sulfonic acid solution | 25 g/l |
| Nitric acid solution | 20% w/w |
| Potassium iodide solution | 25 g/l |

When n ml of the 0.01N iodine solution is consumed, the content of reducing substances is given in an amount of $SO_2$ (mg) per kilogram of gelatin by the following expression:

$$SO_2=(32\times n)\ \text{mg/kg}$$

The content of reducing substances is preferably 15 to 5 ppm in terms of $SO_2$.

With regard to other substances which might be contained in the dispersion medium, it is desirable that the content of heavy metal ions be as small as possible. For example, the content of Fe ions is desirably not more than 40 ppm, more desirably not more than 10 ppm, and most desirably not more than 4 ppm.

The content of $NO_3$ is desirably 500 to 15000 ppm, more desirably 1000 to 10000 ppm, and most desirably 2000 to 8000 ppm.

Further, the content of Ca is desirably 100 to 8000 ppm, more desirably 2000 to 6000 ppm.

The time to use the dispersion medium containing less reducing substances is desirably in the interval between nucleus formation and completion of grain growth, more desirably in the interval between completion of nucleus formation and completion of grain growth, and most desirably in the interval between grain growth and completion of grain growth.

The means to make an oxidizing environment, such as addition of an oxidizing agent and exclusion of reducing substances from the dispersion medium, may be employed singly or in combination of these two means. Preferably, the two means are combined to obtain an oxidizing environment much more securely.

The effect of the invention can be demonstrated much more clearly as the peak intensity and the long-lived component intensity in the photoconductivity measurement become larger; but, when these become too large, photographic properties such as graininess are lowered.

The ranges of the peak intensity and the long-lived component intensity are preferably 3.5 to 10.0 and 0.50 to 2.0, respectively, especially 4.0 to 8.0 and 0.60 to 1.5, respectively.

In silver halide emulsions according to the invention, there can be used silver bromide, silver iodobromide, silver chloride, silver chlorobromoiodide or a mixture thereof.

As methods for preparing silver halide grains, the neutral method, the acid method and the ammoniacal method are known. A method which uses an ammoniacal silver nitrate solution is called the ammoniacal method, and the silver halide emulsion of the invention can be advantageously prepared by this ammoniacal method. In this method, silver halide emulsions are usually prepared under high pH conditions; but, in the preparation of the emulsion of the invention, the pH of an ammoniacal silver nitrate solution is preferably not more than 10.5, especially not more than 10.0, and the pH during the silver halide emulsion preparation is 1 to 8, preferably 2 to 7.5, and especially 5 to 7.5.

In producing the silver halide emulsion of the invention, it is preferable that halide ions be fed in the form of an aqueous solution of an alkali halide such as KI, NaI, KBr or NaBr, or in the form of their mixed solution in the form of silver halide fine grains, as practiced in general.

In one preferable mode of the invention, the surface phase, the low iodide content phase and the high iodide content phase of grains contained in an emulsion, preferably all the phases constituting the grains, are partly or wholly fed by the fine grain feeding method. In each of these modes, 60% or more, preferably 80% or more of each phase is formed by the fine grain feeding method. Particularly preferably, each phase is wholly formed by the fine grain feeding method.

As methods to form silver halide grains by feeding fined-sized silver halide grains, there can be used a method of feeding silver halide fine grains alone or a method accompanied by feed of aqueous solutions of halides and silver salts as disclosed in Japanese Pat. O.P.I. Pub. No. 167537/1990. Between the two, the method of feeding silver halide fine grains alone is particularly preferred for its capability of forming uniform silver halide grains.

The method for forming surface phases of silver halide grains is not particularly limited, except that such surface phases are partly or wholly formed by use of fine-sized silver halide grains. For example, silver halide fine grains having a desired silver iodide content can be used to form a surface phase having a silver iodide content higher than that in the inner phase adjacent thereto. Further, there may also be used silver iodide fine grains singly or in combination with silver halide fine grains having a different silver halide composition, in order to give a desired silver iodide content to the surface phase. Such a surface phase may be formed immediately following the formation of silver halide grains which serve as cores of the surface phase, or after the preparation of the core grains (for example, after desalting and washing, or after, during or before chemical ripening). In addition, a crystal habit control agent may be used in order to form a surface phase having a high silver iodide content in a specific portion on the surface of core grains.

The surface phase may be formed at a time or step by step in several times.

In the invention, the size of fine-sized silver halide grains (occasionally referred to as silver halide fine grains) fed in a nucleus forming process and/or a crystal growing process of silver halide grains is not more than 0.1 μm, preferably not more than 0.05 μm and especially not more than 0.03 μm. The size of these silver halide grains can be determined by measuring, for example, a grain diameter or a projected area of a grain on an electron microphotograph having a magnification of 30,000 to 60,000.

When silver halide fine grains are added in a nucleus forming process and/or a crystal growing process of light-sensitive silver halide grains, (a) these may be prepared in advance and added at use, or (b) these may be prepared and added in parallel with the progress of these processes.

In the case of (b), the standing time of these fine grains between nucleus formation and addition is so short that the increase in their sizes due to the Ostwald ripening among the grains can be controlled. A continuous addition of these fine grains attended by concurrent preparation thereof is particularly effective in minimizing the standing time.

When light-sensitive silver halide grains have at least one phase comprised of mixed crystals of two or more silver halides and said phase is formed by feeding silver halide fine grains, (1) there may be used silver halide fine grains having a silver halide composition corresponding to that of desired light-sensitive silver halide grains, or (2) there may be added two or more types of silver halide fine grains different in silver halide compositions, simultaneously or separately, in a mixing ratio corresponding to the silver halide composition of desired light-sensitive silver halide grains.

There are no particular limitations on the method of feeding fine grains as well as the silver halide composition and the number of types of fine grains to be added. These may be arbitrarily combined in the preparation of silver halide emulsions.

However, in case light-sensitive silver halide grains have at least two layers different in silver halide compositions and said layers are formed by feeding silver halide fine grains, the feed of the fine grains according to above (a), when selected, is carried out preferably in combination with (2) in view of production efficiency.

Reducing the size of silver halide fine grains is essential for a higher solubility. Use of a sparingly gelable dispersion medium, such as a protective colloid in the fine grain preparation, reduces the preparation temperature and, therefore, produces much finer grains.

The term "sparingly gelable dispersion medium" used here means a dispersion medium selected from (A) low-molecular weight gelatins and (B) synthetic high-molecular compounds and natural high-molecular compounds other than gelatin, which are difficult to gel, as compared with a usual photographic gelatin having an average molecular weight larger than 70,000, and act as a protective colloid for silver halide grains.

It is preferable for the silver halide photographic light-sensitive material of the invention to use a monodispersed silver halide emulsion. "A monodispersed silver halide emulsion" is an emulsion in which the weight of silver halide grains having a grain size within average grain size d±20% is not less than 70%, preferably not less than 80% and especially not less than 90% of the total silver grain weight.

In such a monodispersed emulsion, the grain size distribution extent, which is given by centupling the value obtained by dividing a standard deviation of grain sizes by an average grain size, is not more than 20% and preferably not more than 15%.

The silver halide emulsion of the invention is comprised of grains having an average grain size of preferably 0.1 to 10 μm, especially 0.1 to 5.0 μm.

The silver halide emulsion used in the invention is preferably a silver iodobromide emulsion, but it may contain silver chloride within the range not harmful to the effect of the invention.

At least one emulsion layer of the light-sensitive material according to the invention may contain at least two silver halide emulsions different in average grain sizes. Between the two, one emulsion having a larger average grain size (hereinafter referred to as a primary emulsion) is required to have a silver iodide content not less than 9 mol %, and the other emulsion having a smaller average grain size (hereinafter referred to as a secondary emulsion) should have a silver iodide content of not more than 9 mol %. The preferable silver iodide content of a primary emulsion is 9 to 30 mol %, and that of a secondary emulsion is 8.5 to 1 mol %.

As the emulsion of the invention, a core/shell type emulsion is advantageously used. A preferable example is an emulsion comprised of grains having a clear core/-shell type multiple structure. The wording "clear core/-shell type multiple structure" used here can be elucidated by utilizing the method described by H.Hirsh in "Journal of Photographic Science", Vol. 10 (1962), from page 129 onward.

According to this method, the expression "grains having a clear core/shell type multiple structure" indicates that a diffraction curve of the grain has substantially two diffraction peaks. A particularly preferred emulsion is comprised of grains having a diffraction pattern in which one minimum appears, with respect to iodide content, between a diffraction peak corresponding to a low iodide content area and a diffraction peak corresponding to an inner high iodide content area, and the intensity of the diffraction peak corresponding to the high iodide content area is 1/10 to 3/1 of the intensity of the diffraction peak corresponding to the low iodide content area.

The silver halide grains of the invention preferably have a high silver iodide content phase inside of each grain. The silver iodide content of such a high silver iodide content phase is 15 to 45 mol %, preferably 20 to 42 mol % and especially 25 to 40 mol %.

Silver halide grains having an inner high silver iodide content phase according to the invention have the structure in which the high silver iodide content phase is covered with the low silver iodide content phase having a lower silver iodide content.

The average silver iodide content of the low silver iodide content phase which constitutes the outermost phase is preferably not more than 6 mol %, especially 0 to 4 mol %. Further, there may be present an intermediate silver iodide content phase between the outermost phase and the high silver iodide content phase.

The silver iodide content of the intermediate phase is preferably 10 to 22 mol %, especially 12 to 20 mol %.

The difference in silver iodide content between the outermost phase and the intermediate phase, and that between the intermediate phase and the inner high silver iodide content phase are each preferably not less than 6 mol %, especially not less than 10 mol %.

In the above mode, there may be present another silver halide phase at the center of the inner high silver iodide content phase, between the inner high silver iodide content phase and the intermediate phase or between the intermediate phase and the outermost phase.

The volume of the outermost phase is preferably 4 to 70%, especially 10 to 50% of the whole grain volume; the volume of the high silver iodide content phase is desirably 10 to 80%, more desirably 20 to 50%, most desirably 20 to 45% of the whole grain volume; and the volume of the intermediate phase is preferably 5 to 60%, especially 20 to 55% of the whole grain volume.

Each of these phases may be any of a single phase having a uniform composition, a group of phases in which each phase has a uniform composition and thereby the composition changes stepwise, a continuous phase in which the composition changes continuously, and combinations thereof.

In another mode of the silver halide emulsion of the invention, silver iodide localized in a grain does not form a phase having a substantially uniform composition, and the silver iodide content continuously changes from the grain center to its peripheral portion. In this case, it is preferable that the silver iodide content decrease monotonously from the point in a grain where the silver iodide content is the highest to the peripheral portion of the grain.

The silver iodide content at the point where the silver iodide content is the highest is preferably 15 to 45 mol %, especially 25 to 40 mol %.

Further, the silver iodide content at the grain surface is preferably not more than 6 mol %, especially 0 to 4 mol %.

It is preferable that the silver halide emulsion of the invention satisfy at least one of the following requirements (1) to (4).

(1) When an average silver iodide content ($J_1$) determined by fluorescent X-ray spectroscopy is compared with a grain surface silver iodide content ($J_2$) determined by X-ray photo electron spectroscopy, the relation of $J_1 > J_2$ is to be valid.

"Grain size" used here means the diameter of a circumscribed circle of a face which gives the maximum projected area of a grain.

X-ray photo electron spectroscopy is described hereunder.

Prior to the measurement by X-ray photo electron spectroscopy, a sample emulsion is subjected to pretreatment. That is, gelatin hydrolysis is firstly carried out by adding a protease solution to the emulsion and stirring it for 1 hour at 40° C. After sedimenting emulsion grains by centrifugation, the supernatant is removed, and the protease solution is added to perform the gelatin hydrolysis again in the same manner as the above. After centrifuging the sample and removing the supernatant, distilled water is added thereto to re-disperse the emulsion grains in the distilled water, followed by centrifugation and removal of the supernatant. After repeating this washing procedure three times, the emulsion grains are re-dispersed in ethanol, then this dispersion is thinly coated on a mirror-finished silicon wafer. Thus, a sample for measurement is obtained.

In the measurement by X-ray photo-electron spectroscopy, ESCA/SAM Model 560 made by PHI Co., for example, is used as a measuring apparatus. The measurement is made using a Mg-Kα ray as an exciting X-ray under the conditions of X-ray source voltage: 15 KV, X-ray source current: 40 mA, pass energy: 50 eV.

In order to determine the surface halide composition, Ag3d, Br3d and Isd3/2 electrons are detected. Calculation of the composition ratio is made according to the relative sensitivity coefficient method using integrated intensities of respective peaks. By use of 5.10, 0.81 and 4.592 as respective relative sensitivity coefficients of Ag3d, Br3d and Isd3/2, the composition ratio is given in atomic percentages.

(2) When an average silver iodide content ($J_1$) determined by fluorescent X-ray spectroscopy is compared with a mean value ($J_3$) of silver iodide contents measured by X-ray micro-analysis on silver halide crystal faces at distances more than 80% of the radius from the center of the silver halide grain in the diametral direction, the relation of $J_1 > J_3$ is to be valid.

The procedure of X-ray microanalysis is described below. Silver halide grains are scattered on an electron microscopic observation grid of an electron microscope equipped with an energy dispersive X-ray analyzer and cooled with liquid nitrogen. After setting the magnification so as to have one grain come into the CRT display scope, the intensities of AgLα-ray and ILα-ray are integrated for a prescribed time. The silver iodide content can be calculated using the intensity ratio of ILα/AgLα and an analytical curve prepared beforehand.

(3) At an intensity of maximum peak×0.13 in a (420) X-ray diffraction curve with a CuKα radiation, a signal is continuously present over an angle of diffraction not less than 1.5 degrees. Desirably, a signal is continuously present over an angle of diffraction not less than 1.5 degrees at an intensity of maximum peak×0.13; more desirably, a signal is present over an angle of diffraction not less than 1.8 degrees; and most desirably, a signal is present over a range not less than 2.0 degrees. The wording "signal is present" means that the signal intensity is higher than maximum peak×0.13 or 0.15 at the points so-specified.

In an particularly preferred mode of the silver halide emulsion of the invention, the above (420) X-ray diffraction signal with a CuKα radiation has two or three peaks. One having three peaks is the most advantageous.

X-ray diffraction is a well-known method for examining crystal structure of a silver halide.

Various characteristic X-rays can be used as X-ray sources. Of these, a CuKα-ray using Cu as a target is used most widely.

Silver iodobromide has a rock salt structure, and its (420) diffraction curve with CuKα radiation can be observed in 2θ of 71 to 74 degrees. Since the signal intensity is relatively high, a high resolution is obtained; therefore, it is best suited for the analysis of the crystal structure.

In X-ray diffraction of a photographic emulsion, it is necessary to remove gelatin, mix a standard sample such as silicon with the sample, and measure the sample by the powder method.

The measurement can be made by referring to "Kiso Bunseki Kagaku Koza, Vol. 24, X-ray Bunseki" (Fundamental Analytical Chemistry Course, Vol. 24, X-ray Analysis), by Kyoritsu Publishing Co.

(4) When an average silver iodide content of silver halide grains is determined by the above X-ray microanalysis, the relative standard deviation of the measured values is not more than 20%, preferably not more than 15% and especially not more than 12%.

"The relative standard deviation" is given by centupling the value obtained by dividing a standard deviation of silver iodide contents (measured using, for example, at least 100 emulsion grains) by an average silver iodide content.

The silver halide emulsion of the invention may be comprised of regular crystals such as cubes, tetradecahedrons, or octadecahedrons, twin crystals such as plates, or mixtures thereof.

When tabular twin crystal grains are used, it is desirable that grains having a (diameter of a converted circle equivalent to a projected grain area)/(grain thickness) ratio of 1 to 20 amount to 60% or more of the total projected area. This ratio is more desirably 1.2 to 8.0 and most desirably 1.5 to 5.0.

An emulsion comprised of monodispersed regular crystal grains can be prepared according to methods described, for example, in Japanese Pat. O.P.I. Pub. Nos. 177535/1985, 138538/1985, 52238/1984, 143331/1985, 35726/1985, 258536/1985, 14636/1986.

An emulsion comprised of monodispersed twin crystal grains can be prepared by referring to a method for growing spherical seed grains described, for example, in Japanese Pat. O.P.I. Pub. No. 14636/1986.

The growth of such seed grains is carried out preferably by adding an aqueous solution of silver nitrate and an aqueous solution of a halide by the double-jet method. Iodine can also be added in the form of silver iodide. The addition speed must be properly selected not to form new nucleus and not to widen the grain size distribution due to the Ostwald ripening; that is, the addition is advantageously performed in a range of 30 to 100% of the speed at which a new nucleus is formed.

In the course of silver halide grain formation or physical ripening thereof, there may coexist cadmium salts, zinc salts, lead salts, thallium salts, iridium salts or complex salts thereof, rhodium salts or complex salts thereof, or iron salts or complex salts thereof.

Other conditions to growth grains include a method in which grains are grown by adding, dissolving and recrystallizing silver halide fine grains, as seen on page 88 of Summaries of Lectures at 1983 National Meeting of the Photographic Society of Japan.

Preferred silver halide grain growth conditions are pAg: 5 to 11, temperature: 40° to 85° C., pH: 1.5 to 12.

In the invention, the silver halide emulsion is subjected to physical ripening, chemical ripening and spectral sensitizing before use. Additives, couplers and the like usable in these processes can be seen in Research Disclosure Nos. 17643, 18716 and 308119 (hereinafter referred to as RD17643, RD18716 and RD308119, respectively).

The additives used in the invention can be added by the dispersion method or the like described in RD308119XIV.

In the invention, there can be used the supports described in RD17643, p. 28, RD18716647, pp. 47–48, and RD308119XVII.

The light-sensitive material according to the invention can have auxiliary layers such as an intermediate layer and a filter layer described in RD308119VII-Sec. K.

The light-sensitive material according to the invention can have various layer configurations such as conventional layer order, inverted layer order and unit layer structure described in RD308119VII-Sec. K.

The present invention can be applied to a variety of color light-sensitive materials represented by color negative films for general uses and for movies, color reversal films for slides and for TVs, color papers, color positive films and color reversal papers.

The light-sensitive material of the invention can be processed by the conventional methods described in RD17643, pp. 28–29, RD18716, p. 647, and RD308119XVII.

EXAMPLES

The effect of the present invention is hereunder exemplified.

| (Preparation of comparative emulsion Em-A) | |
|---|---|
| Solution $A_1$ | |
| Ossein gelatin | 37 g |
| Disodium propyleneoxy polyethyleneoxy disuccinate (10% methanol solution) | 10 ml |
| Twin crystal seed emulsion (average grain size: 0.30 μm, average AgI content: 2 mol %) equivalent to 0.191/mol | |
| Water was added to make | 4000 ml |
| Solution $B_1$ | |
| Silver nitrate | 1168 g |
| Water was added to make | 6248 ml |
| Solution $C_1$ | |
| Ossein gelatin | 109 g |
| Potassium bromide | 804 g |
| Potassium iodide | 23.1 g |
| Water was added to make | 4628 ml |

Solutions $B_1$ and $C_1$ were added to solution $A_1$ by the double-jet method over a period of 112 minutes with stirring at 65° C. During the addition, the pH was maintained at 2.0 with nitric acid, and the pAg was kept at 9.0. The addition speed of solutions $B_1$ and $C_1$ was linearly increased to give a final speed 6.4 times as large as the initial speed.

After the addition, the reaction liquor was adjusted to pH 6.0 and then desalted by the usual method. Emulsion Em-A thus obtained was comprised mainly of tabular twin crystal grains having an average grain size of 1.6 μm and an average silver iodide content of 2.0 mol %.

Preparation of Comparative Emulsion Em-B

Emulsion Em-B comprised mainly of tabular twin crystal grains was prepared in the following manner:

| | |
|---|---|
| Solution $A_2$ | |
| Ossein gelatin | 76.8 g |
| Potassium bromide | 3.0 g |
| Disodium propyleneoxy polyethyleneoxy disuccinate (10% methanol solution) | 10 ml |
| Water was added to make | 4000 ml |
| Twin crystal seed emulsion (average grain size: 0.36 μm, average AgI content: 2 mol %) equivalent to 0.191/mol | |
| Solution $B_{2-1}$ | |
| Silver nitrate | 194.5 g |
| Nitric acid (s.g. 1.38) | 4.1 ml |
| Water was added to make | 1309 ml |
| Solution $C_{2-1}$ | |
| Ossein gelatin | 52.4 g |
| Potassium bromide | 95.4 g |
| Potassium iodide | 57.0 g |

-continued

| | |
|---|---|
| Water was added to make | 1309 ml |
| Solution $B_{2-2}$ | |
| Silver nitrate | 195.4 g |
| Nitric acid (s.g. 1.38) | 2.0 ml |
| Water was added to make | 575 ml |
| Solution $C_{2-2}$ | |
| Ossein gelatin | 23.0 g |
| Potassium bromide | 116.3 g |
| Potassium iodide | 28.6 g |
| Water was added to make | 575 ml |
| Solution $B_{2-3}$ | |
| Silver nitrate | 777.6 g |
| Nitric acid (s.g. 1.38) | 8.1 ml |
| Water was added to make | 2289 ml |
| Solution $C_{2-3}$ | |
| Ossein gelatin | 91.6 g |
| Potassium bromide | 539.4 g |
| Potassium iodide | 7.60 g |
| Water was added to make | 2289 ml |

The apparatus described in Japanese Pat. O.P.I. Pub. No. 160128/1987 was arranged to be able to divide a feed solution into 6 portions, by setting 6 feed nozzles toward the part under the stirring blades for each of the solution $B_2$ group (solutions $B_{2-1}$ to $B_{2-3}$, to be switched for each solution) and the solution $C_2$ group (solutions $C_{2-1}$ to $C_{2-3}$, to be switched for each solution).

Solutions $B_{3-1}$ and $C_{3-1}$ were added by the double-jet method to solution $A_3$ at 75° C. with stirring at 450 rpm. The addition speed was increased linearly against the addition time, from the initial addition speed of 11.62 ml/min to the final addition speed of 25.63 ml/min. The pAg was maintained at 8.2. After the addition of solutions $B_{3-1}$ and $C_{3-1}$, the pAg was adjusted to 8.45 with 3.5N aqueous solution of potassium bromide, then the stirring speed was raised to 500 rpm.

Subsequently, solutions $B_{3-2}$ and $C_{3-2}$ were added thereto with stirring by the double-jet method. During the addition, the addition speed was increased linearly against the addition time from the initial addition speed of 15.59 ml/min to the final addition speed of 18.51 ml/min, and the pAg was maintained at 8.45.

When the addition of solutions $B_{2-2}$ and $C_{2-2}$ was completed, the stirring speed was raised to 550 rpm.

While stirring the reaction liquor, solutions $B_{2-3}$ and $C_{2-3}$ were added thereto by the double-jet method at a linearly increasing addition speed from the initial speed of 41.19 ml/min to the final speed of 68.07 ml/min. During the addition the pAg was controlled at 8.45.

After the addition, the reaction liquor was adjusted to pH 6.0 with an aqueous solution of potassium hydroxide (1.78N) and, then, desalted according to the usual method. Emulsion Em-B thus obtained was comprised mainly of core/shell type tabular twin grains having an average grain size of 1.27 μm and an average silver iodide content of 8.0 mol %.

Preparation of Inventive Emulsion Em-C

Emulsion Em-C was prepared in the following procedure:

The same procedure as with emulsion Em-B was repeated, except that 0.5% methanol solution of iodine was added to solution $A_2$, immediately before the addition of the seed emulsion thereto, so as to give an iodine addition amount of 25.5 mg per mol of silver nitrate.

Preparation of Inventive Emulsion Em-D

Seed emulsion

Regular crystal seed emulsion (average grain size: 0.27 μm, average AgI content: 2 mol %) equivalent to 0.206 mol AgX (AgX is a silver halide, the same applies hereinafter)

| | |
|---|---|
| Solution $A_4$ | |
| Ossein gelatin | 235.87 g |
| Sodium polyisopropylene-disuccinate (10% aqueous ethanol solution) | 30 ml |
| Water | 9150.7 ml |
| Acetic acid (56% aqueous solution) | 1500 ml |
| Aqueous ammonia (28%) | 1056 ml |
| Solution $C_4$ | |
| Ossein gelatin | 160 g |
| Potassium bromide | 1666.1 g |
| Water | 3275.6 ml |
| (Solution C-1) | |
| Solution $B_4$ | |
| Silver nitrate | 1679 g |
| Aqueous ammonia (28%) | 1369.6 ml |
| Water was added to make | 2823.5 ml |
| Solution $D_4$ | |
| AgI emulsion 1 | 252.2 ml |
| (average grain size: 0.060 μm) | 0.84 mol |
| 4-Hydroxy-6-methyl-1,3,3a,7-tetrazaindene (hereinafter referred to as TAI) | 5.22 g |
| Water | 22.4 ml |
| Solution $E_4$ | |
| KBr (20% aqueous solution) | an amount to adjust pAg |
| Solution $F_4$ | |
| Acetic acid (56% aqueous solution) | an amount to adjust pH |

By use of the above solutions, emulsion Em-D was prepared. That is, 0.5% methanol solution of iodine was added to solution $A_4$ at 60° C. in an iodide amount of 25.5 mg per mol of silver nitrate, while stirring the liquor with the stirrer disclosed in Japanese Pat. O.P.I. Pub. Nos. 92523/1982, 92524/1982. Then, solutions $B_4$, $C_4$ and $D_4$ were added thereto by the double-jet mixing method, while controlling the pAg, the pH and the addition speed of these solutions as shown in Tables 1 and 2.

TABLE 1

| Time (min) | 0 | | 110 | | 111 | | 123 | | 138 | | 146 | | 163 |
|---|---|---|---|---|---|---|---|---|---|---|---|---|---|
| pH | 7.0 | → | 7.0 | ↓ | 6.0 | → | 6.0 | → | 6.0 | → | 6.0 | → | 6.0 |
| pAg | 7.8 | → | 7.8 | ↓ | 9.7 | ↗ | 9.8 | ↘ | 10.0 | ↘ | 10.1 | → | 10.1 |

→ mean to keep the pH and pAg constant, to change slowly, ↓ to change rapidly.

TABLE 2

| Time (min) | Addition Speed of Solution (ml/min) | | |
|---|---|---|---|
| | Solution $C_4$ | Solution $B_4$ | Solution $D_4$ |
| 0 | 5.5 | 5.8 | 0 |
| 27.5 | 6.3 | 6.6 | 0 |
| 54.9 | 4.5 | 4.7 | 24.1 |
| 76.9 | 5.6 | 5.8 | 29.9 |
| 95.2 | 6.5 | 6.8 | 9.9 |
| 110.9 | 17.6 | 10.5 | 11.1 |
| 123.5 | 30.0 | 16.4 | 4.8 |
| 132.3 | 40.8 | 23.5 | 6.9 |
| 138.6 | 61.3 | 32.2 | 9.5 |
| 143.2 | 93.8 | 44.4 | 13.1 |
| 146.7 | 61.1 | 55.6 | 16.4 |
| 149.5 | 68.7 | 62.6 | 18.4 |
| 152.2 | 72.6 | 66.2 | 19.5 |
| 154.7 | 76.4 | 69.6 | 20.5 |
| 157.2 | 80.1 | 73.0 | 21.5 |

TABLE 2-continued

| Time (min) | Addition Speed of Solution (ml/min) | | |
|---|---|---|---|
| | Solution $C_4$ | Solution $B_4$ | Solution $D_4$ |
| 163.1 | 90.7 | 84.2 | 0 |

During the double-jet mixing, the control of pAg and pH was made by changing the flow of solutions $E_4$ and $F_4$ by use of a variable flow roller tube pump.

After the grain formation, desalting was performed according to the method disclosed in Japanese Pat. O.P.I. Pub. No. 4003/1990. Emulsion Em-D thus obtained was comprised of core/shell type octahedral regular crystal grains having an average grain size of 1.0 μm and an average silver iodide content of 8.00 mol %.

Preparation of Light-sensitive Material Sample

In this example, the addition amount of each component is in grams per square meter.

| Sample 101 | |
|---|---|
| 1st layer: antihalation layer (HC) | |
| Black colloidal silver | 0.16 |
| UV absorbent (UV-1) | 0.20 |
| High boiling solvent (Oil-1) | 0.16 |
| Gelatin | 1.23 |
| 2nd layer: intermediate layer (IL-1) | |
| Compound (SC-1) | 0.15 |
| High boiling solvent (Oil-2) | 0.17 |
| Gelatin | 1.27 |
| 3rd layer: low-speed red-sensitive emulsion layer (RL) | |
| Silver iodobromide emulsion (average grain size: 0.38 μm AgI content: 8.0 mol %) | 0.50 |
| Silver iodobromide emulsion (average grain size: 0.27 μm, AgI content: 2.0 mol %) | 0.21 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-5}$ |
| Sensitizing dye (SD-4) | $1.0 \times 10^{-4}$ |
| Cyan coupler (C-1) | 0.48 |
| Cyan coupler (C-2) | 0.14 |
| Colored cyan coupler (CC-1) | 0.021 |
| DIR compound (D-1) | 0.020 |
| High boiling solvent (Oil-1) | 0.53 |
| Gelatin | 1.30 |
| 4th layer: medium-speed red-sensitive emulsion layer (RM) | |
| Silver iodobromide emulsion (average grain size: 0.52 μm, AgI content: 8.0 mol %) | 0.62 |
| Silver iodobromide emulsion (average grain size: 0.38 μm, AgI content: 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |

-continued

| Sample 101 | |
|---|---|
| High boiling solvent (Oil-1) | 0.30 |
| Gelatin | 0.93 |
| 5th layer: high-speed red-sensitive emulsion layer (RH) | |
| Silver iodobromide emulsion (Em-A) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.91 |
| 6th layer: intermediate layer (IL-2) | |
| Compound (SC-1) | 0.09 |
| High boiling solvent (Oil-2) | 0.11 |
| Gelatin | 0.80 |
| 7th layer: low-speed green-sensitive emulsion layer (GL) | |
| Silver iodobromide emulsion (average grain size: 0.38 μm, AgI content: 8.0 mol %) | 0.61 |
| Silver iodobromide emulsion (average grain size: 0.27 μm, AgI content: 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| 8th layer: medium-speed green-sensitive emulsion layer (GM) | |
| Silver iodobromide emulsion (average grain size: 0.59 μm, AgI content: 8.0 mol %) | 0.87 |
| Sensitizing dye (SD-6) | $2.4 \times 10^{-4}$ |
| Sensitizing dye (SD-7) | $1.1 \times 10^{-4}$ |
| Magenta coupler (M-1) | 0.058 |
| Magenta coupler (M-2) | 0.13 |
| Colored magenta coupler (CM-1) | 0.07 |
| DIR compound (D-3) | 0.002 |
| High boiling solvent (Oil-2) | 0.50 |
| Gelatin | 1.0 |
| 9th layer: high-speed green-sensitive emulsion layer (GH) | |
| Silver iodobromide emulsion (Em-A) | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.84 |
| Magenta coupler (M-3) | 0.064 |
| Colored magenta coupler (CM-1) | 0.012 |
| High boiling solvent (Oil-1) | 0.27 |
| High boiling solvent (Oil-2) | 0.012 |
| Gelatin | 1.0 |
| 10th layer: yellow filter layer (YC) | |
| Yellow colloidal silver | 0.08 |
| Antistain agent (SC-2) | 0.15 |
| High boiling solvent (Oil-2) | 0.19 |
| Gelatin | 1.10 |
| Formalin scavenger (HS-1) | 0.20 |

-continued

| Sample 101 | |
|---|---|
| 11th layer: intermediate layer (IL-3) | |
| Formalin scavenger (HS-1) | 0.20 |
| Gelatin | 0.60 |
| 12th layer: low-speed blue-sensitive emulsion layer (BL) | |
| Silver iodobromide emulsion (average grain size: 0.38 μm, AgI content: 8.0 mol %) | 0.22 |
| Silver iodobrmide emulsion (average grain size: 0.27 μm, AgI content: 2.0 mol %) | 0.03 |
| Sensitizing dye (SD-8) | $4.9 \times 10^{-4}$ |
| Yellow coupler (Y-1) | 0.75 |
| High boiling solvent (Oil-2) | 0.30 |
| Gelatin | 1.20 |
| Formalin scavenger (HS-1) | 0.073 |
| 13th layer: medium-speed blue-sensitive emulsion layer (BM) | |
| Silver iodobromide emulsion (average grain size: 0.59 μm, AgI content: 8.0 mol %) | 0.30 |
| Sensitizing dye (SD-8) | $1.6 \times 10^{-4}$ |
| Sensitizing dye (SD-9) | $7.2 \times 10^{-4}$ |
| Yellow coupler (Y-1) | 0.10 |
| DIR compound (D-1) | 0.01 |
| High boiling solvent (Oil-2) | 0.046 |
| Gelatin | 0.47 |
| 14th layer: high-speed blue-sensitive emulsion layer (BH) | |
| Silver iodobromide emulsion (Em-A) | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling solvent (Oil-2) | 0.046 |
| Gelatin | 0.8 |
| 15th layer: 1st protective layer (Pro-1) | |
| Silver iodobromide emulsion (average grain size: 0.08 μm, AgI content: 1.0 mol %) | 0.40 |
| UV absorbent (UV-1) | 0.065 |
| UV absorbent (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| 16th layer: 2nd protective layer (Pro-2) | |
| Alkali-soluble matting agent (average particle size: 2 μm) | 0.15 |
| Polymethylmethacrylate (average particle size: 3 μm) | 0.04 |
| Slipping agent (WAX-1) | 0.04 |
| Gelatin | 0.55 |

In addition to the above compositions, there were added coating aid Su-1, dispersant Su-2, a viscosity regulator, hardeners H-1 and H-2, stabilizer ST-1, antifoggants AF-1, AF-2, (Mw: 1,100,000) and (Mw: 10,000) and (Mw: 10,000) antiseptic DI-1. The addition amount of antiseptic DI-1 was 9.4 mg/m$^2$.

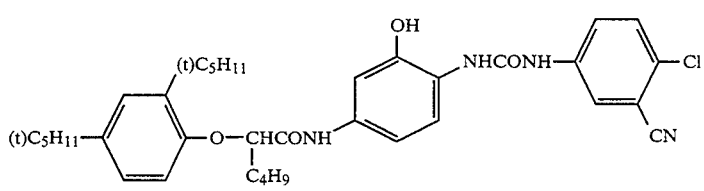

C-1

-continued
C-2
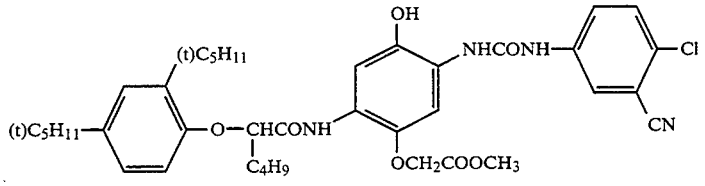
M-1
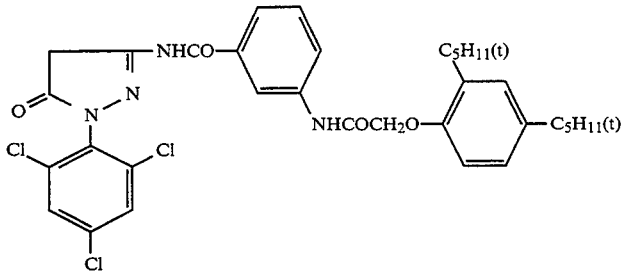
M-2
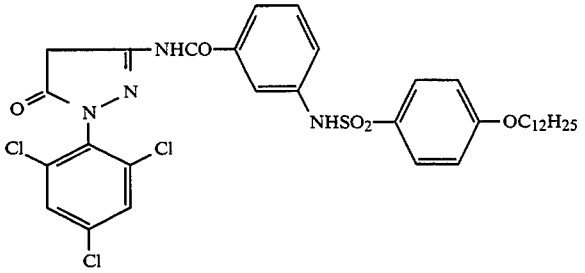
M-3
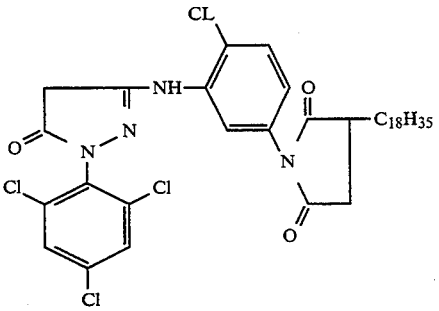
Y-1
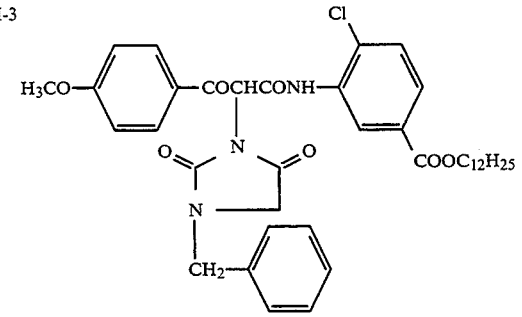
CC-1
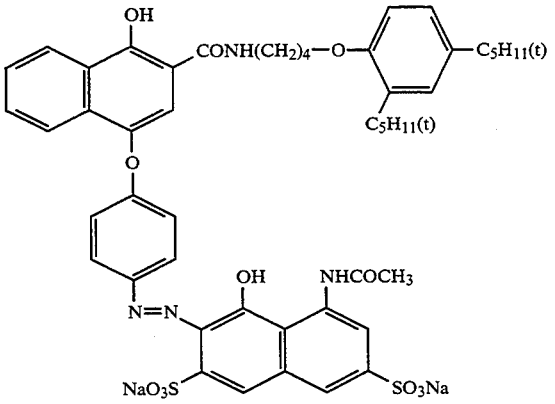

-continued
CM-1
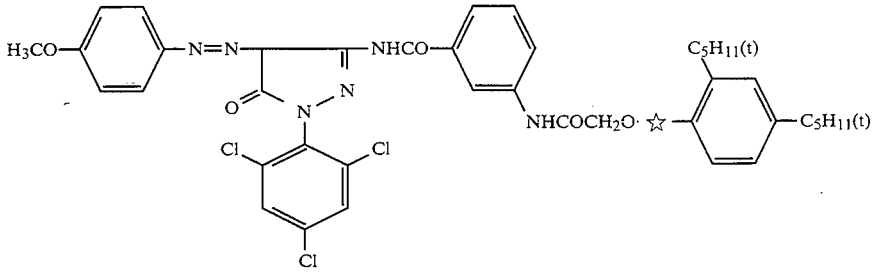
D-1
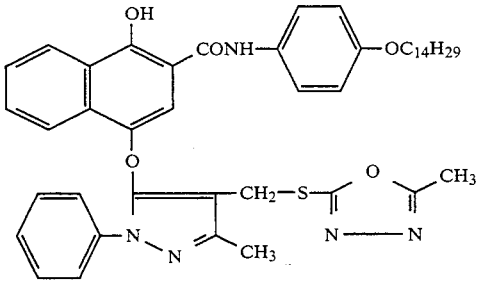
D-2
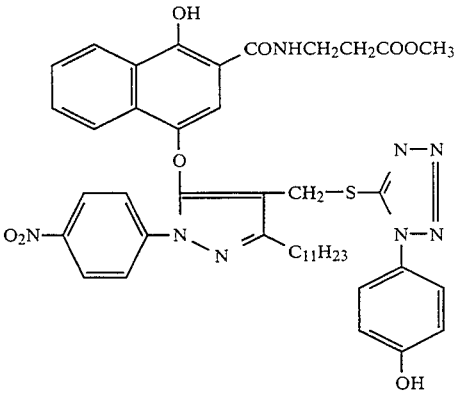
D-3
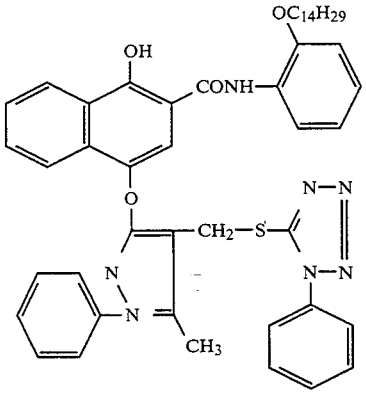
Oil-1
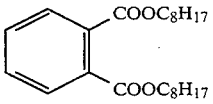
Oil-2
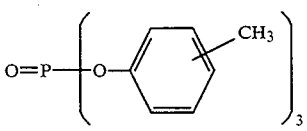
Oil-3
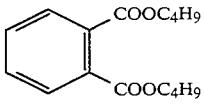
SC-1
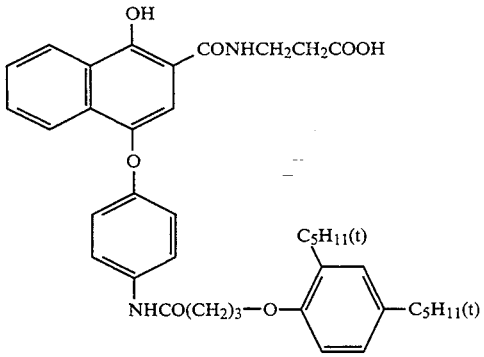
SC-2
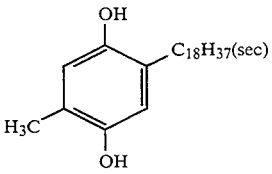

-continued
UV-1
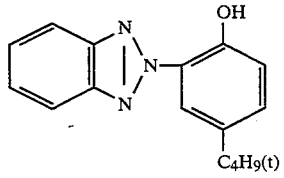
UV-2
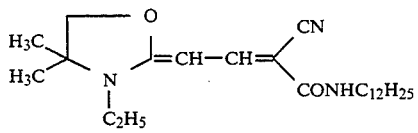
WAX-1
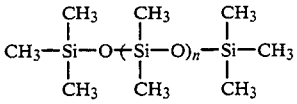
Su-1
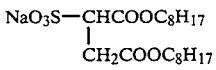
Su-2
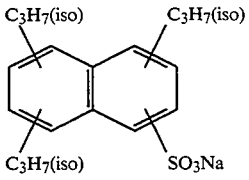
HS-1
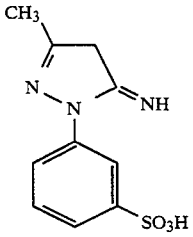
UV-1
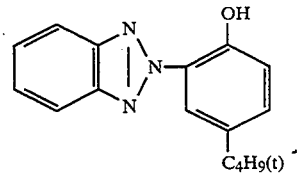
UV-2
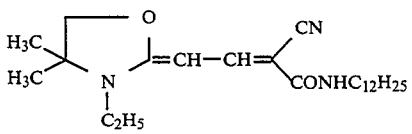
WAX-1
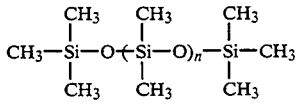
Su-1
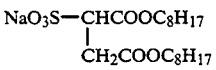
Su-2
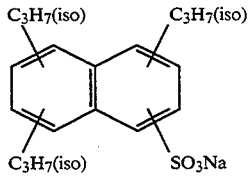
HS-1
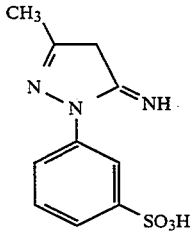
Weight average molecular weight = 3,000
SD-1
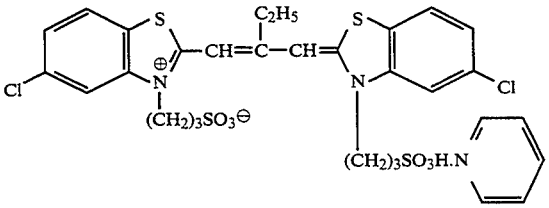
SD-2
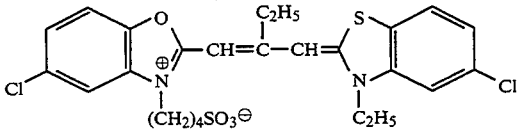
SD-3
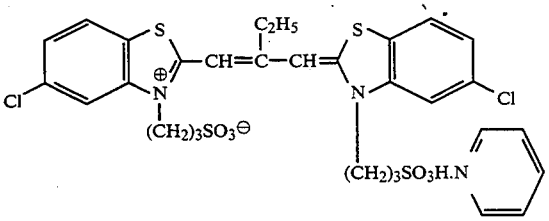
SD-4
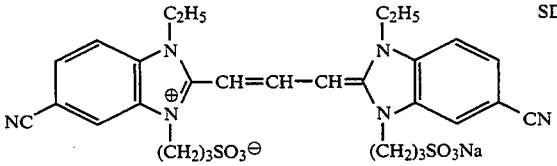

-continued
SD-5
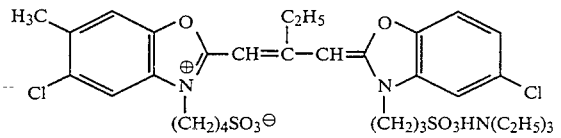
SD-6
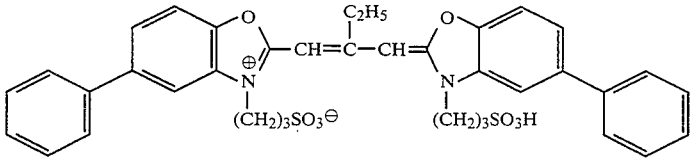
SD-7
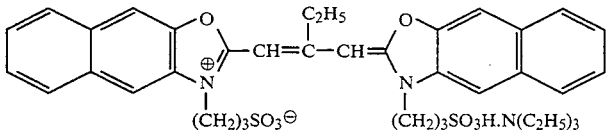
SD-8
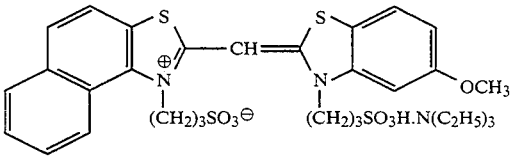
SD-9
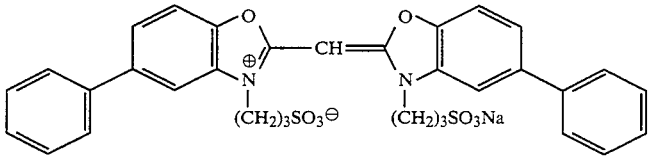
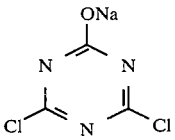
H-1
$(CH_2{=}CHSO_2CH_2)_2O$
H-2
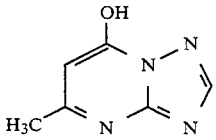
ST-1
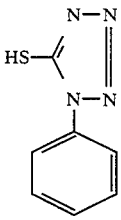
AF-1
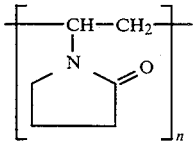
n: polymerization degree
AF-2
DI−1=(mixture of the following 3 components)
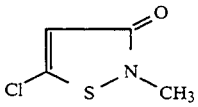
(Component A)
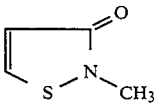
(Component B)
-continued
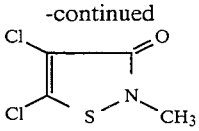
(Component C)
Component A:Component B:Component C: 50:46:4 (molar ratio)

Preparation of Samples 102 to 104

Sample 102: Sample 102 was prepared in the same manner as with sample 101, except that Em-A in the 5th, 9th and 14th layers of sample 101 was replaced by Em-B.

Sample 103: Sample 103 was prepared in the same manner as with sample 101, except that Em-A in the 5th, 9th and 14th layers of sample 101 was replaced by Em-C.

Sample 104: Sample 104 was prepared in the same manner as with sample 101, except that Em-A in the 5th, 9th and 14th layers of sample 101 was replaced by Em-D.

The samples prepared as above were evaluated in the following procedure:

Measurement of Photoconductivity

Samples 101 to 103 were subjected to the above measurement to determine the peak intensity and the long-lived component intensity.

Measurement of Sensitivity and Fog

The samples were exposed to white light in the usual manner (1/100 sec) through an optical step wedge for sensitometry. The samples were processed under the following conditions and then subjected to sensitometry. The sensitometry was conducted for each of blue, green and red. The fog was determined as the density at a nonexposed portion, the sensitivity was obtained as the reciprocal of an exposure to give a density of fog +0.3 and reported in values relative to the sensitivity of sample 101, which was set at 100.

Evaluation of High Illuminance Reciprocity Law Failure

Each sample was exposed in a short time ($1/10^5$ sec) under the condition to receive the same exposure as that in the usual exposing, and the sensitivity was determined in the same manner as with the sample subjected to the usual exposing. Then, the difference between the sensitivity thus obtained and the sensitivity in the usual exposing was determined as a measure to indicate the high illuminance reciprocity law failure property.

Evaluation of Preservability

To examine the preservability under a forced aging, each sample was kept in an environment of 40° C. and 80% RH for 7 days and then subjected to exposure, color development and sensitometry under the same condition as with non-aged samples. As a measure to indicate the preservability, the increment of fog (ΔFog) in the aged sample over the non-aged sample was determined.

(Processing conditions)

| Process Processing | Processing Replenishing Time (sec) | Temperature (°C.) | Amount (ml) |
|---|---|---|---|
| Color developing | 195 | 38 ± 0.3 | 780 |
| Bleaching | 45 | 38 ± 2.0 | 150 |
| Fixing | 90 | 38 ± 2.0 | 830 |
| Stabilizing | 60 | 38 ± 5.0 | 830 |
| Drying | 60 | 55 ± 5.0 | — |

The replenishing amount is per square meter.

(Recipes of processing solution)

Color developer

| | |
|---|---|
| Water | 800 ml |
| Potassium carbonate | 30 g |
| Potassium hydrogencarbonate | 2.5 g |

-continued (Recipes of processing solution)

Color developer

| | |
|---|---|
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxyethyl) aniline sulfate | 4.5 g |
| Diethylenetriaminepentacetic acid | 3.0 g |
| Potassium hydroxide | 1.2 g |

Water is added to make 1 liter, then the pH is adjusted to 10.06 with potassium hydroxide or 20% sulfuric acid.

Color developing replenisher

| | |
|---|---|
| Water | 800 ml |
| Potassium carbonate | 35 g |
| Potassium hydrogencarbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxyethyl)aniline sulfate | 6.3 g |
| Potassium hydroxide | 2 g |
| Diethylenetriaminepentacetic acid | 3.0 g |

Water is added to make 1 liter, then the pH is adjusted to 10.18 with potassium hydroxide or 20% sulfuric acid.

Bleacher

| | |
|---|---|
| Water | 700 ml |
| Ammonium ferric 1, 3-diaminopropanetetracetate | 175 g |
| Ethlenediaminetetracetic acid | 2 g |
| Sodium nitrate | 40 g |
| Ammonium bromide | 150 g |
| Glacial acetic acid | 40 g |

Water is added to make 1 liter, then the pH is adjusted to 4.4 with aqueous ammonia or glacial acetic acid.

Bleaching replenisher

| | |
|---|---|
| Water | 700 ml |
| Ammonium ferric 1, 3-diaminopropanetetracetate | 175 g |
| Ethlenediaminetetracetic acid | 2 g |
| Sodium nitrate | 50 g |
| Ammonium bromide | 200 g |
| Glacial acetic acid | 56 g |

The pH is adjusted to 6.2 with aqueous ammonia or glacial acetic acid, then water is added to make 1 liter.

Fixer

| | |
|---|---|
| Water | 800 ml |
| Ammonium thiocyanate | 120 g |
| Ammonium thiosulfate | 150 g |
| Sodium sulfite | 15 g |
| Ethlenediaminetetracetic acid | 2 g |

The pH is adjusted to 6.2 with aqueous ammonia or glacial acetic acid, then water is added to make 1 liter.

| Fixing replenisher | |
|---|---|
| Water | 800 ml |
| Ammonium thiocyanate | 150 g |
| Ammonium thiosulfate | 180 g |
| Sodium sulfite | 20 g |
| Ethlenediaminetetracetic acid | 2 g |

The pH is adjusted to 6.5 with aqueous ammonia or glacial acetic acid, then water is added to make 1 liter.

| Stabilizer and stabilizing replenisher | |
|---|---|
| Water | 900 ml |
| $C_8H_{17}$— 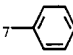 —O—$(C_2H_4O)_{10}$H | 2.0 g |
| Dimethylol ures | 0.5 g |
| Hexamethylenetetramine | 0.2 g |
| 1,2-Benzisothiazoline-3-one | 0.1 g |
| Siloxane (L-77 made by Union Carbide Corp.) | 0.1 g |
| Aqueous ammonia | 0.5 ml |

Water is added to make 1 liter, then the pH is adjusted to 8.5 with aqueous ammonia or glacial acetic acid.

TABLE 3

| | Photoconductivity Intensity | | Relative Photographic Sensitivity | | | High Illumination Reciprocity Law Failure Characteristic | | | Increase in Fog | | |
|---|---|---|---|---|---|---|---|---|---|---|---|
| Sample | Peak | After 8 μ.sec | R | O | P | R | O | P | R | O | P |
| Comparison | 5.1 | 0.42 | 100 | 100 | 100 | 11 | 16 | 15 | 0.04 | 0.05 | 0.07 |
| Comparison | 3.2 | 0.60 | 114 | 111 | 109 | 9 | 6 | 7 | 0.09 | 0.12 | 0.23 |
| Invention | 4.1 | 0.62 | 119 | 121 | 123 | 5 | 4 | 5 | 0.02 | 0.03 | 0.03 |
| Invention | 3.9 | 0.65 | 121 | 118 | 120 | 6 | 4 | 4 | 0.03 | 0.05 | 0.03 |

It is understood from the results in Table 3 that the samples of the invention are high in sensitivity, low in fog and excellent in high illuminance reciprocity law failure property.

What is claimed is;

1. A silver halide photographic light-sensitive material comprising silver halide grains displaying an induced absorption peak intensity of not less than 3.5 units and a long-lived light component intensity of not less than 0.50 microwave photo conductivity units.

2. The silver halide photographic light-sensitive material of claim 1, wherein said peak intensity is 3.5 to 10.0 and said long-lived light component intensity is 0.50 to 2.0.

3. The silver halide photographic light-sensitive material of claim 1, wherein said peak intensity is 4.0 to 8.0 and said long-lived light component intensity is 0.60 to 1.5.

4. The silver halide photographic light-sensitive material of claim 1, wherein at least one phase constituting said grains is formed by a fine grain feeding method.

5. The silver halide photographic light-sensitive material of claim 4, wherein a size of fine-sized silver halide grains fed by the fine grain feeding method is not more than 0.1 μm.

6. The silver halide photographic light-sensitive material of claim 1, wherein a silver halide emulsion of said material is a monodispersed emulsion in which an amount of said silver halide grains having a grain size within average grain size d±20% is not less than 70%.

7. The silver halide photographic light-sensitive material of claim 1, wherein said grains are core/shell type grains.

8. The silver halide photographic light-sensitive material of claim 7, wherein a silver iodide content of said silver halide core/shell type grains is within the range of 15 to 45 mol %.

9. A silver halide photographic light-sensitive material of claim 1, wherein said peak intensity is within the range of 3.5 to 10.0 units and said long-lived light component intensity is within a range of 0.50 to 2.0 units and silver nuclei present during a period spanning silver halide nucleus formation to completion of grain growth of said silver halide grains of said material are reduced by a condition selected from the group consisting of an oxidizing environment, presence of an inhibitor and use of an acid method.

10. The silver halide photographic light-sensitive material of claim 1 wherein said silver halide grains are present in a silver halide emulsion meeting at least one requirement selected from the group consisting of Requirement 1, Requirement 2, Requirement 3, and Requirement 4;

Requirement 1: when an average silver iodide content ($J_1$), determined by X-ray fluorescence spectroscopy, is compared to a grain surface silver iodide content ($J_2$), determined by X-ray photoelectron spectroscopy, $J_1$ is greater than $J_2$, Requirement 2: when an average silver iodide content ($J_1$), determined by X-ray fluorescence spectroscopy, is compared to a mean silver iodide content ($J_3$), measured by X-ray microanalysis of silver halide crystal faces at a distance of more than 80% of a radius from the center of the silver halide grain in a diametric direction, $J_1$ is greater than $J_3$, Requirement 3: at an intensity of maximum peak×0.13, in a (420) X-ray diffraction curve with Cu-Kα radiation, a signal is continuously present over an angle of diffraction of not less than 1.5°, Requirement 4: when an average silver iodide content of the silver halide grains is determined by X-ray microanalysis, a relative standard deviation of the measure value is not more than 20%.

* * * * *